US007371442B2

(12) United States Patent
Pitman

(10) Patent No.: US 7,371,442 B2
(45) Date of Patent: May 13, 2008

(54) ARTIFICIAL FOLIAGE

(76) Inventor: David B. Pitman, P.O. Box 902, Lomax, IL (US) 61454

( * ) Notice: Subject to any disclaimer, the term of this patent is extended or adjusted under 35 U.S.C. 154(b) by 82 days.

(21) Appl. No.: 10/888,475

(22) Filed: Jul. 12, 2004

(65) Prior Publication Data

US 2006/0008598 A1 Jan. 12, 2006

(51) Int. Cl.
*A41G 1/00* (2006.01)

(52) U.S. Cl. ..... 428/23; 428/17; 428/27; 428/919; 135/901

(58) Field of Classification Search ..... 428/17, 428/23, 24, 919, 27; 135/901; 43/1
See application file for complete search history.

(56) References Cited

U.S. PATENT DOCUMENTS 1,150,027 A 8/1915 Gates
4,215,163 A 7/1980 Lee
5,221,565 A 6/1993 Johnson
5,320,884 A 6/1994 Tai
5,395,664 A 3/1995 Thompson
5,759,645 A 6/1998 Li
6,037,021 A * 3/2000 Koo ..... 428/10
6,093,459 A * 7/2000 Puleo, Jr. ..... 428/20
6,306,471 B1 * 10/2001 Pitman et al. ..... 428/18

FOREIGN PATENT DOCUMENTS

JP 2001132273 A * 5/2001

* cited by examiner

*Primary Examiner*—John J. Zimmeraman
*Assistant Examiner*—Aaron Austin
(74) *Attorney, Agent, or Firm*—Joseph W. Holloway

(57) ABSTRACT

An artificial foliage structure with wire cores embedded in its leafy parts causing these parts to "spring back" upon removal of compressive loading acting thereupon. These wire cores may be made of hard, springy steel such as piano wire or small diameter spring wire. Thicker, woody limbs and branches have embedded therein heavier wire cores that are sufficiently soft to be given a set solely by manually applied bending force.

1 Claim, 2 Drawing Sheets

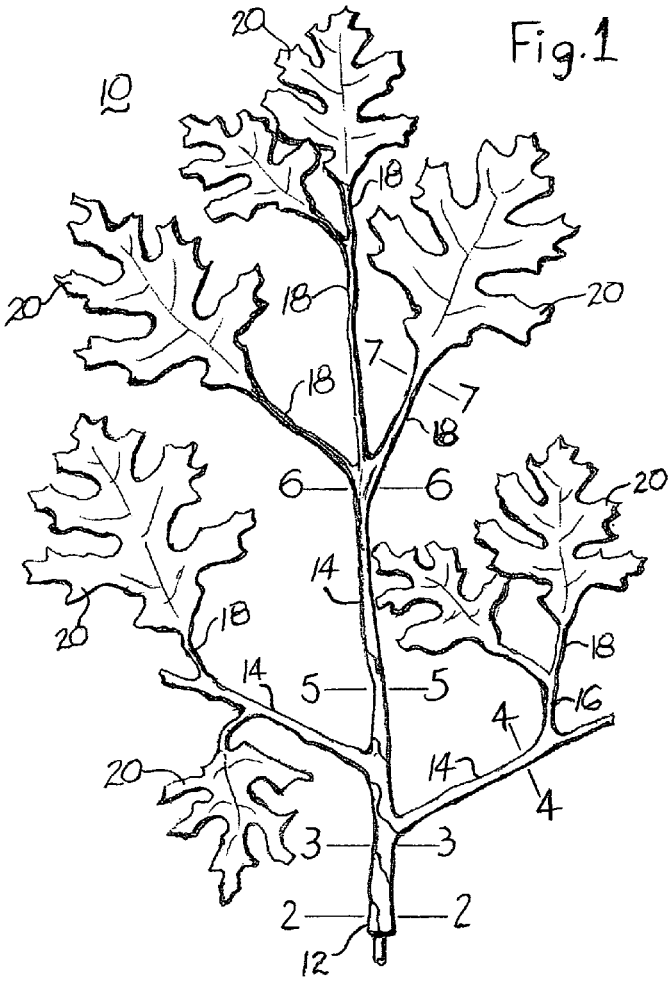
Fig. 1
10
20
18
7
6
14
5
4
16
3
2
12
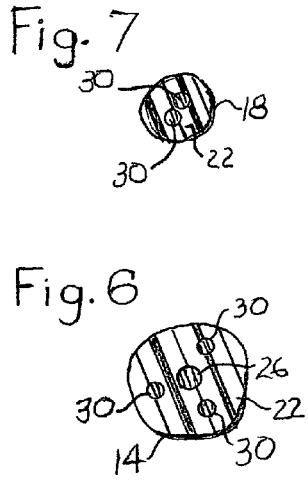
Fig. 7
30
18
22
Fig. 6
30
26
22
14
Fig. 5
14
22
26
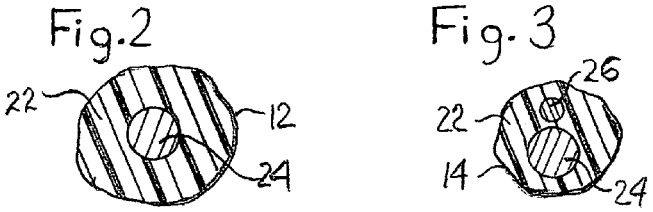
Fig. 2
22
12
24
Fig. 3
26
22
14
24
Fig. 4
28
22
16
26

ARTIFICIAL FOLIAGE

BACKGROUND OF THE INVENTION

This invention relates to a naturally appearing artificial foliage assembly comprising limbs, branches, stems and leaves. The foliar elements disclosed herein represent certain improvements over those of the arborescent concealment artifice previously disclosed in U.S. Pat. No. 6,306,471 issued to D. B. Pitman, the present inventor.

Pitman assembles artificial foliar components such as limbs, branches, stems and leaves by means of a unitarily molded plastic encasement or sheath. According to Pitman, his components have discrete reinforcing wire core portions which are joined by molding his plastic sheath thereabout. Pitman envisions a life-like foliar structure which a user can draw in about himself by plastically bending the skeletal wire framework carrying his foliar components. To facilitate ready bending of the framework for concealment and for reverse bending to a restored condition, Pitman suggests these characteristics and properties for a suitable skeletal wire framework: "The diameter and length of a particular wire segment depends on which woody part of the foliage will contain that wire segment. For example, the longer, stiffer limbs have encapsulated therein the longest and heaviest wire segments while the wire forming the flexible leaf stems are relatively short and lightweight. All of the skeletal wire segments comprise a malleable mild steel which, when covered with the aforesaid flexible sheath, afford the woody parts of the foliage structure a semi-rigged nature and a degree of life-like flexibility. It is important that the skeletal wire core be plastically deformable, i.e. bendable at the location desired and to a degree desired by no more than moderate manual force. It should be understood that the wire cores molded in all parts of the foliar structure must provide sufficient strength to prevent these parts from slumping under their own weight or from bending or breaking in windy conditions . . . . The longer, stiffer links may contain wire cores up to six feet or more in length and three sixteenths of an inch in diameter while the wire diameters of the shorter, more pliable branches and stems are much less."

That Pitman positively requires that the core wires of all parts of his foliar structure be deformable by manual bending is clear from his specification which recites, inter alia, "After the limbs are secured to a support, such as a tree trunk . . . , the plastically deformable limbs, branches and leaf stems are bent by the user to accomplish his obscuration. Should the user choose to position himself in front of the structure, the limbs can be bent forwardly and then inwardly to enclose the user entirely within the artificial foliage of the surrounding structure. Thereafter, the user may bend individual branches and leaf stems to enhance the illusion of a naturally foliaged tree or bush having as desired size, array, opacity and coloration . . . . By shaping easily bendable branches, branchlets and leaves, an observation or shooting port of a desirable size and shape can be fashioned as needed and later closed if desired. The density of the simulated foliage, hence its opacity, need not be uniform but can be increased or decreased by bending and layering or overlapping the branches and leaves in selected areas of the overall array."

Pitman's concealment structure is well suited to achieve the objectives recited in his patent and has enjoyed considerable commercial success; however, first hand field experience has demonstrated a need to reduce dramatically the time and effort expended by a user in erecting and adjusting the structure prior to use.

Initially, one or more main supporting limbs, along with its appended branches, stems and leaves, are bunched together to permit their being fitted inside boxes or bags in which they are initially sold. Likewise, after the structure has been employed in the field, the stems and leaves previously arrayed by the user are manually gathered and forcibly collapsed into an elongated bundle for easier transportation and storage. Such compaction of the relatively inelastic wire cores of the stem and leaf portions of the wire framework causes them to take on a set condition which will not likely meet the user's needs upon subsequent redeployment of the structure. Therefore, time-consuming and tedious manual straightening and/or rebending of stem and leaf portions of the structure can be expected. Alleviation of this drawback displayed by the Pitman structure is the principal objective of the present invention.

While the inventor is aware of the several prior art patents which are somewhat related to the present invention in that each discloses an artificial foliage assembly having an encased metallic core, none recognizes the same problem and none suggests a solution for this problem. In this regard, please refer to U.S. Pat. No. 1,150,027 issued Aug. 17, 1915 to Gates; U.S. Pat. No. 4,215,163 issued Jul. 29, 1980 to Lee; U.S. Pat. No. 5,221,565 issued Jun. 22, 1993 to Johnson; U.S. Pat. No. 5,320,884 issued Jun. 14, 1994 to Tai et al; U.S. Pat. No. 5,395,664 issued Mar. 7, 1995 to Thompson; and, U.S. Pat. No. 5,759,645 issued Jun. 2, 1998 to Li.

SUMMARY OF THE INVENTION

This invention has as its principal objective the provision of an artificial foliar structure which can be set up for use more readily than similar devices heretofore known. To this end, the present invention proposes that certain of the wire components which collectively form the interior framework of an artificial foliar structure vary not only in length and diameter, for the aforestated reasons, but that they also differ in strength and hardness.

Another object is to provide a simulated plastic leaf molded about a springy wire segment which extends generally along its centerline. Such wire segment will have a sufficient degree of elasticity to cause it and the leaf to spring back to its original shape and orientation when a deflecting load is removed.

Yet another object is to provide artificial foliage components molded about plural-part cores made up of wire segments having differing resistances to bending and differing elasticities. Thus, the wires encased in large limbs and major branches projecting therefrom are characterized by sufficient ductility and elasticity to allow the user to shape and orient them by giving them a set quickly and with minimal effort. On the other hand, those supporting cores molded inside small branchlets and leaves attached thereto are more lightly constructed, i.e. of smaller diameter, but are made of metal having greater hardness, stiffness and elasticity than do the softer core wires imbedded in the larger, heavier limbs and branches. The principal advantage provided by such differing characteristics of the various core wires is that the cores of the branchlets and myriad leaves of a foliar structure can avoid plastic deformation as the structure is collapsed and, at the same time, store sufficient elastic energy to cause the branchlets and leaves to return to their previous shapes and orientations with little or no user assistance.

A more specific object is to provide a unitary, artificial foliage structure having imbedded springy cores which affords its leafy portions a "snap back" characteristic. To this end, the structure's supporting wire framework is fabricated by positioning wire segments of progessivity smaller diameter and length in the cavity of a typical injection mold then injecting a suitable plastic material to join the wire segments thereby providing a semi-rigid sheath about the embedded wires. Preferably, the smallest diameter wires molded in the terminal branchlets and leaves are made of hard, springy metal such as piano wire, spring wire or the like.

These and other desirable features and objects of this invention and the manner of obtaining them will become apparent and the invention will be more fully understood by having reference to the following detailed description of the invention taken in conjunction with the accompanying drawings.

DESCRIPTION OF THE DRAWINGS

FIG. 1 is a partial elevational view showing a portion of an artificial foliage structure including a central branch, side branches, branchlets and leaves.

FIG. 2 is an enlarged cross sectional view taken along lines 2-2 of FIG. 1.

FIG. 3 is a view similar to FIG. 2 taken along lines 3-3 of FIG. 1.

FIG. 4, is a view similar to FIG. 2 taken along lines 4-4 of FIG. 1;

FIG. 5, is a view similar to FIG. 2 taken along lines 5-5 of FIG. 1;

FIG. 6, is a view similar to FIG. 2 taken along lines 6-6 of FIG. 1;

FIG. 7, is a view similar to FIG. 2 taken along lines 7-7 of FIG. 1;

DETAILED DESCRIPTION OF THE INVENTION

Figure 8:
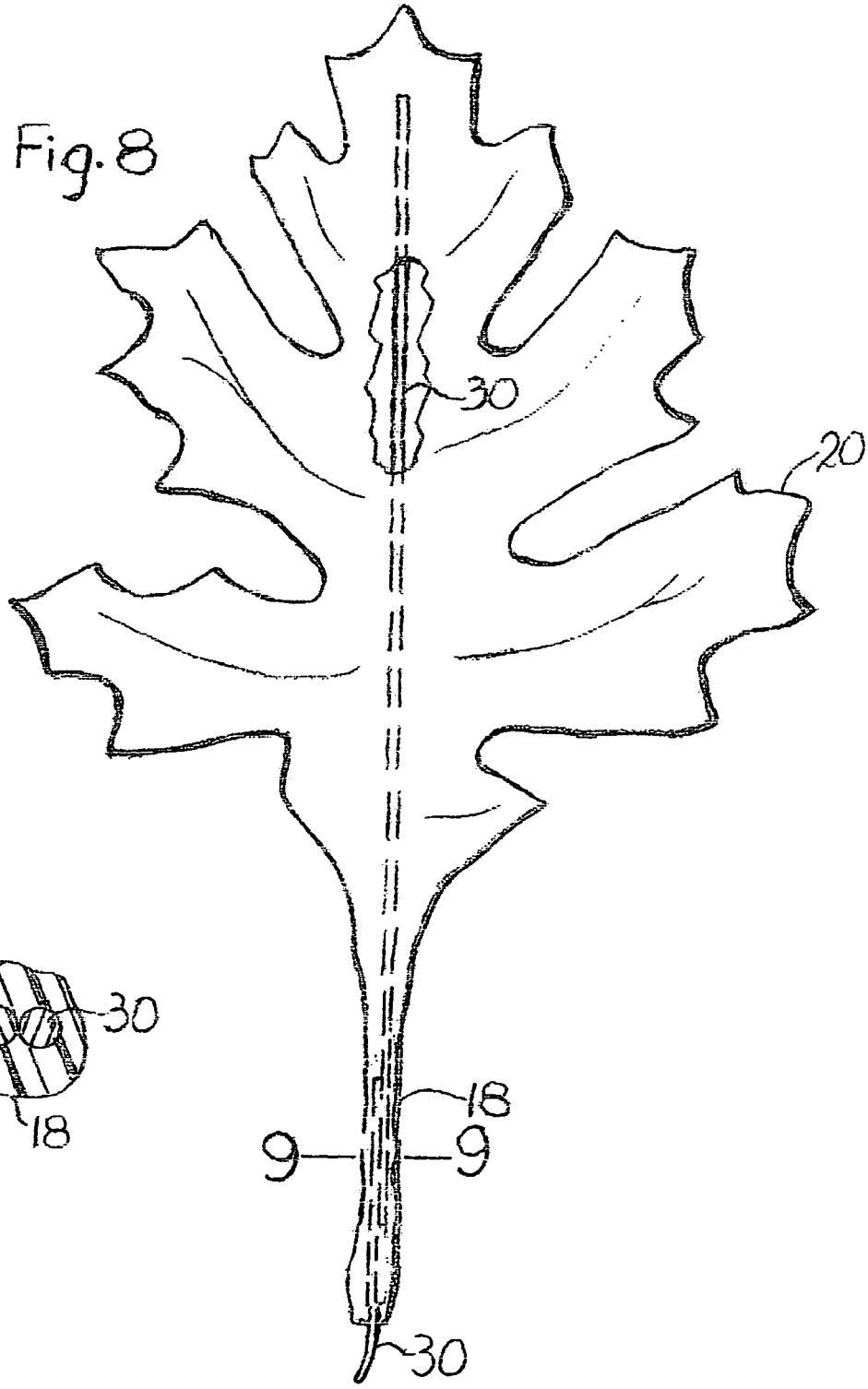
FIG. 8, is a plan view of one of the leaves depicted in FIG. 1 which shows by a central broken away surface portion and by broken lines the cores encased in the leaf and leaf stem; and, FIG. 9 is an enlarged cross section taken along lines 9-9 of FIG. 8.

An artificial foliage structure, designated in its entirety by numeral 10 in FIG. 1 of the drawings, may be fabricated using a previously known method whereby overlapping end segments of metallic wires are laid side by side in an elongated cavity of an injection mold of suitable size and shape. After the cavity is filled with plastic material which is allowed to harden, the wire segments will be held in position within a resulting semi-rigid casing. As will be fully described hereinafter, the individual wire segments comprise a composite interior framework for the foliage structure which secures the constituent foliar parts together, more or less as shown in FIG. 1, while permitting a degree of flexibility of the individual parts.

FIG. 1 is illustrative of one of the many different foliar structures that can be fabricated using the molding method suggested above. Commonly, such structures include a central limb 12 which supports laterally extending main branches 14 that carry branchlets 16 having attached stems 18 and leaves 20. The central, heavier limb 12 which may be of any desired length, may have its proximal end removably supported and retained in a socket or like receptacle, not shown. While only three main branches 14 have been shown, the limb 12, if made longer than shown in FIG. 1, may have additional side branches extending therefrom each carrying its own array of branchlets, stems and leaves. As shown in FIGS. 2 through 7, the cross sections of the molded artificial limbs, branches, branchlets and stems decrease generally in the same manner as do those of natural tree structures. The plastic material employed to mold the casing 22 is a matter of choice providing only that its displays good molding characteristics, is durable in outdoor environments, and is suitably strong yet flexible to permit a desired degree of flexing and bending without fracturing. The cross sectional thickness of the casing 22 about the skeletal wire core may be nonuniform to give the wood parts of the foliar components a natural appearance and the sheath's surface may be embossed to have a roughened or bark-like surface.

The limb portion 12 of the tree spray structure 10 may be of any length dictated by the intended use of the structure. In the illustrative embodiment of the invention depicted in FIG. 1, the length of limb 12 is on the order of 75 cm; the main branches 14 are about 25 cm; the branchlets 16 vary from 5 cm to 10 cm in length; and, the leaf stems 18 are about 5 cm in length. It will be understood that the length of the various components of the foliar structure as well as the spacing and location of points of attachment for their proximal ends will be determined by the species of foliage that is to be artificially reproduced.

The skeletal core of the foliage structure 10 comprises an assemblage of wire segments of variable lengths and cross sectional diameters. The cross sectional views in the accompanying drawings show that the embedded wire segments providing the skeletal core of the structure 10 vary considerably in diameter. For example, the wire 24 encased in limb 12 has a diameter of 3.2 mm; the core wires 26 encased in side branches 14 have a diameter of 1.4 mm; the branchlet wires 28 have a diameter 1.0 mm; and the wires 30 running through and encased in leaf stems 18 and leaves 20 have a diameter of 0.5 mm.

Figure 9:
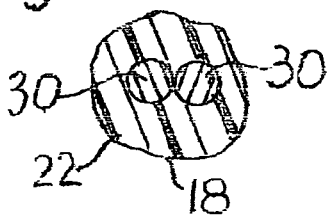

FIGS. 8 and 9 depict a detached leaf stem 18 and leaf 20 illustrative of the several leaves shown in FIG. 1. The core wires 30 are embedded in or jacketed by the leaves and stems, respectively, as an incident to the unitary molding of the foliar structure 10. The wires 30 are juxtaposed, as shown in FIG. 8, and overlap substantially. A leaf core wire 30 extends medially through the leaf 20 so that its distal end of wire 21 closely approaches the distal end of leaf 20.

The various core wire lengths and wire diameters of this invention are similar to those disclosed in the previously referenced U.S. Pat. No. 6,306,471; however, an essential difference between the present invention and the Pitman structure resides in the material specifications for the wire core segments molded into various parts of the foliar structure.

From the above set forth portions of the Pitman specification, it will be understood that his entire skeletal core is fabricated of "suitably malleable mild steel wire" which is "easily bendable". Thus all of Pitman's core wires, including those embedded in his stems and leaves, are required to be easily bendable to accomplish maximum obscuration of a user enclosed within an artificial foliage. According to Pitman, this characteristic of the larger diameter cores is desirable in order to permit ready manual bending. However, it has been observed that the ease with which the lighter, thinner cores of his leaf stems can be plastically deformed and shaped creates the aforenoted problems attending set up of the foliage and detracts significantly from the operational efficiency of the Pitman concealment artifice.

In accordance with this invention and in contradistinction to Pitman, the hardness and stiffness of the encased core wires within the various parts of the structure are nonuniform. The preferred material for the limb and branch core wires 24 and 26 is a malleable, mild steel which will facilitate plastic deformation of these wires by the user during set up and collapse of the structure. On the other hand, the material comprising the branchlet, leaf stem and leaf cores 16, 18 and 20, respectively should display a degree of springiness commonly found in music wire or spring steel wire, for example.

Extensive testing of the effectiveness of various core wire materials to achieve a desired "spring back" or "pop up" type of restoration of the leaf stems 18 and leaves 20 following substantial and repeated compaction of the foliar structure has demonstrated that the following wire characteristics produce superior results:

Material: High carbon alloy steel—nominal analysis C 0.70 to 1.00%, Mn 0.20 to 0.60%

Fabricated by: Cold drawing

Diameter: 0.4 mm to 0.6 mm

Ultimate Tensile Strength (U.T.S.)—1500 to 2500 Mpa

For the above-specified wire diameters, the specified range of U.T.S, which reflects the hardness of the wire, is critical to obtaining and maintaining the desired springiness in the stems and leaves. If the wire's hardness is above the upper limit of the specified range of U.T.S., the leaf stems and leaves are too inelastic and brittle to withstand repeated compaction. If the hardness of these light wires is less than that specified above, the stems and leaves are likely to be bent, folded and twisted by the compressive forces created by collapsing the foliar structure. When such plastic deformation results, time consuming and tedious manual manipulation of the stems 18 and leaves 20 can be expected the next time the structure is deployed.

It will be understood that variations in the specific construction, arrangement, materials, method of molding and end use of the herein disclosed foliar structure can be made without departing from the scope and spirit of the appended claims.

I claim as my invention:

1. A naturally appearing artificial foliage structure including woody and leafy constituant parts made of plastic material encasing therein a skeletal framework of embedded steel wires, wherein:

the hardness of the wires embedded in the leafy parts exceeds the hardness of the wires embedded in the woody parts.

* * * * *